United States Patent [19]

Rendel

[11] Patent Number: 4,714,444

[45] Date of Patent: Dec. 22, 1987

[54] DRINK CAN GLIDER

[76] Inventor: Robert D. Rendel, Rte. #1, Box 826, Laurinburg, N.C. 28352

[21] Appl. No.: 862,265

[22] Filed: May 12, 1986

[51] Int. Cl.[4] ..... A63H 27/18

[52] U.S. Cl. ..... 446/61; 446/77

[58] Field of Search ..... 446/61, 66, 77, 71, 446/63, 64, 34, 78

[56] References Cited

U.S. PATENT DOCUMENTS 3,777,392 12/1973 Span et al. ..... 446/78

3,787,998 1/1974 Kilroy, Jr. et al. ..... 446/61

3,883,983 5/1975 Coster ..... 446/78

*Primary Examiner*—Mickey Yu

*Attorney, Agent, or Firm*—Mills & Coats

[57] ABSTRACT

This invention is an unmanned aircraft which utilizes commonly available drink cans as a fuselage and central connecting point. The aircraft can be used with any pop top-type can, is easy to assemble without tools or adhesive materials, and gives above average performance relative to comparable sized craft. The wings are of break away type to prevent damage in landings or striking of other objects and the can fuselage which takes the brunt of landings can be readily replaced.

13 Claims, 6 Drawing Figures

DRINK CAN GLIDER

FIELD OF INVENTION

This invention relates to aircraft and more particulary to relatively small, unmanned aircraft commonly referred to as model aircraft or planes.

BACKGROUND OF INVENTION

Throughout recorded history, there has been a universal fascination with things that fly. Most of this interest has been concentrated on heavier than air crafts and in its most rudimentary form includes a pair of opposed wings with a body and tail, following the basic configuration of soaring birds.

Even today with the secrets of aerodynamics having been thoroughly explored, the fascination in heavier than air craft remains. The great expense of training to become a pilot and operating an aircraft is cost prohibitive to most people. The thrill of watching pilotless planes and observing their characteristics remains a fascination which is available to people at all economic levels, particularly in the motorless or glider form.

Small pilotless aircraft, commonly referred to as models, come in a myriad of shapes and sizes from the most sophisticated, remotely controlled, power driven aircraft to the simplest hand launched gliders.

In its simplest form, hand launched gliders made of thin balsa wings and tails with an elongated body are inexpensive to purchase and easy to assemble. These gliders usually come two or three to a package since they are so easily broken. Additionally, the flight characteristics and distances achievable with these models are limited and the novelty of the same soon wears off.

Pop top-type soda and beer cans are also universally known and have intrigued many people for years. Some people even collect them. Perhaps, as in the inventor's case, the marvel of their construction along with their colorful decor is what has made them seem too valuable to throw away. For some time the inventor had sensed in himself and others the desire to use these cans for something worthwhile, even after they had served their intended function.

In a moment of inspiration, the inventor combined his love for airplanes and fascination with drink cans and conceived the idea of making drink cans fly.

BRIEF DESCRIPTION OF INVENTION

By drawing on the inventor's experience as a pilot, model builder, and design engineer, and after much research and study into the above mentioned problems, the present invention has been developed to provide a relatively simple, easy-to-assemble model-type aircraft which quickly and readily incorporates on an empty drink can as a fuselage. This aircraft has extremely high glide slope characteristics at relatively low air speeds to add further to the fascination of the same. The present invention also includes break away wings which effectively makes the same crash proof in that whenever an obstruction is encountered, the wings will come off without damage and can be easily reconnected for the next flight. Further, the user can select his favorite colors from the myriad of drink brands on the market, i.e., a Coke can for red, a Seven-Up can for green, etc. Also, of course, a person's favorite brand of beverage could be represented such as Pepsicola or Budwiser.

In the present embodiment, neither tools nor glue are required and assembly can be accomplished by the most methodical person in less than two minutes. The can takes the brunt of landings and the associated scraping and denting and can be readily replaced as necessary. Th user of the present invention can thus get many years of enjoyable service from the same due to the replacement feature and the fact that the remaining portions are made of water and weather proof materials such as thermal plastics.

In view of the above, it is an object of the present invention to provide a model-type aircraft utilizing at least one empty metal-type drink can as part of the aircraft.

Another object of the present invention is to provide a model-type aircraft utilizing at least one empty metal-type drink can as a fuselage with break away wing sections.

Another object of the present invention is to provide a model-type aircraft utilizing at least one empty metal-type drink can as a fuselage.

Another object of the present invention is to provide a model type aircraft utilizing at least one drink can as a fuselage with a combination wing saddle and tail supporting boom attached thereto.

Another object of the present invention is to provide a model-type aircraft using at least one empty drink can as a fuselage with a readily attachable and detachable tail supporting boom.

Another object of the present invention is to provide a combination wing saddle and tail supporting boom for mounting an empty drink-type can as a fuselage.

Another object of the present invention is to provide a model aircraft utilizing an empty drink-type can as a fuselage and having a streamlining nosecone attached thereto.

Other objects and advantages of the present invention will become apparent and obvious from a study of the following description and the accompanying drawings which are merely illustrative of such invention.

DETAILED DESCRIPTION OF INVENTION

Figure 1:
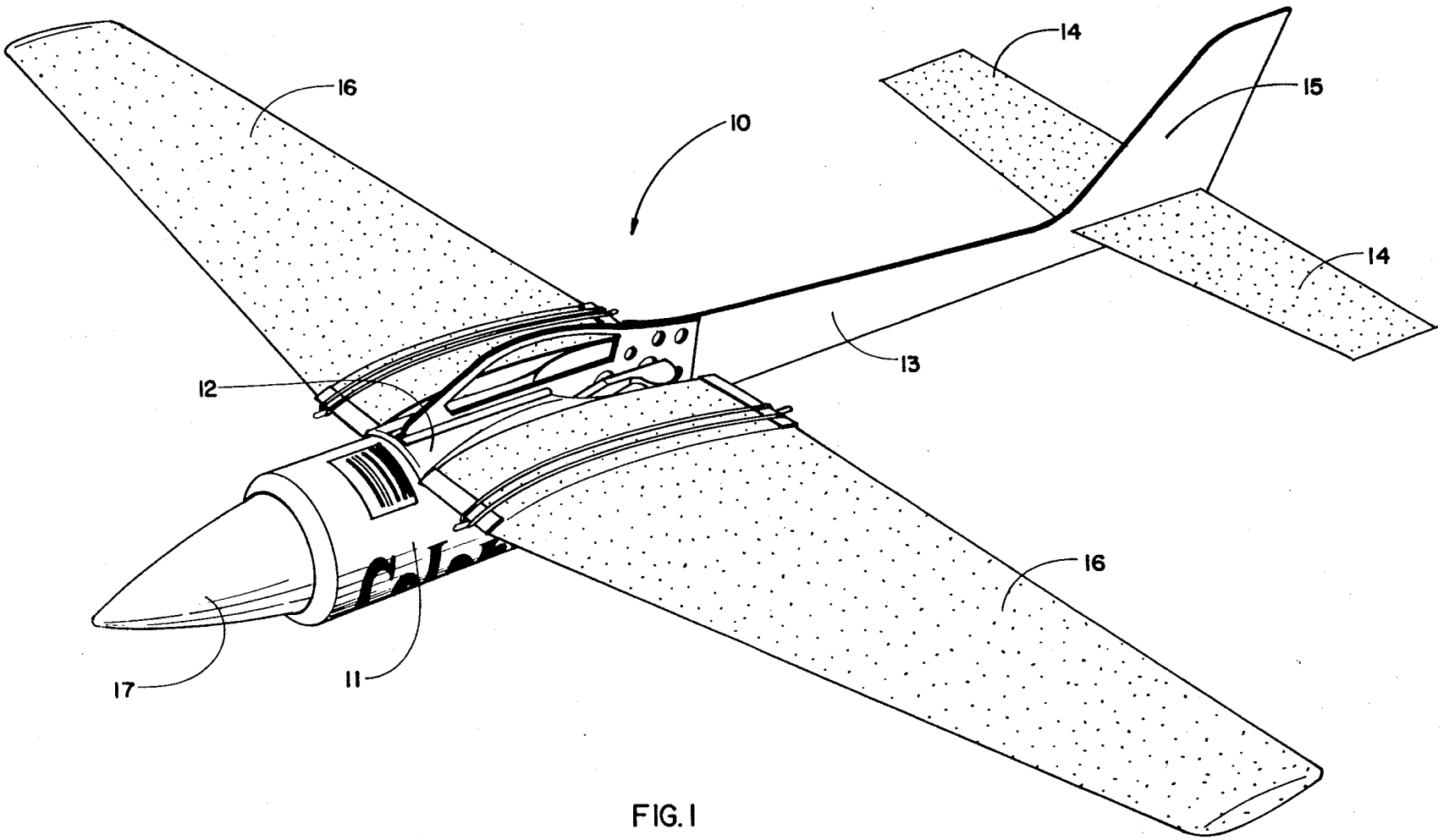
FIG. 1 is a perspective view of the aircraft of the present invention.

With further reference to the drawings, the aircraft of the present invention, indicated generally at 10, includes an empty drink can 11 which forms the fuselage and a wing saddle 12 which is secured to a rearwardly extending tail boom 13. This boom in turn supports an elevator 14 and a rudder 15, both of which function in the normal manner of such devices.

A pair of wings 16 formed from styrofoam or similar material are provided and nose cone 17 is mounted on the forward end of fuselage 11.

Referring more specifically to the drink can fuselage 11, this is a readily available item having a bottom 18, a top 19, and cylinderical sidewall 20. The can also includes the normal pop top opening 21 through which the contents of the can have been emptied.

The wing saddle 12 is airfoil shaped in cross-sectioned in the area of outer panels 22. The upper surface of the forward edges 23 of the trailing edges 24 of the panels 22 forms shoulders which contour to the inwardly projecting tabs 25 of wings 16 to form a smooth upper wing surface when installed as shown in FIG. 1.

Figure 4:
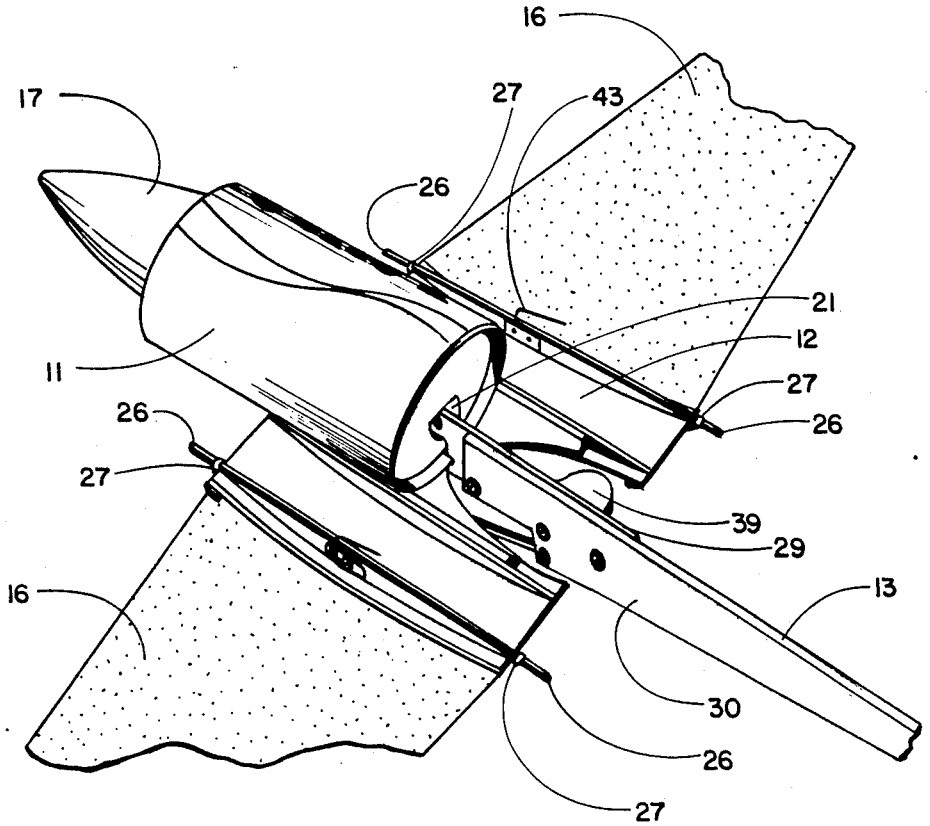
FIG. 4 is a bottom fragmentary view of the present invention.
Figure 5:
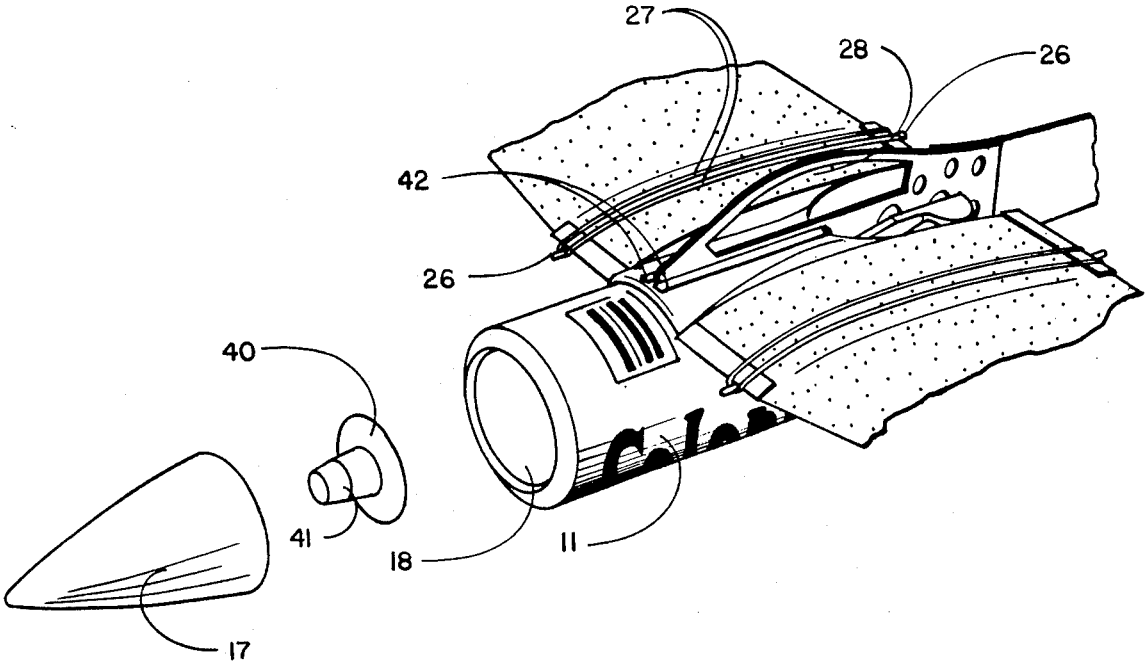
FIG. 5 is a top fragmentary exploded view thereof.
Figure 6:
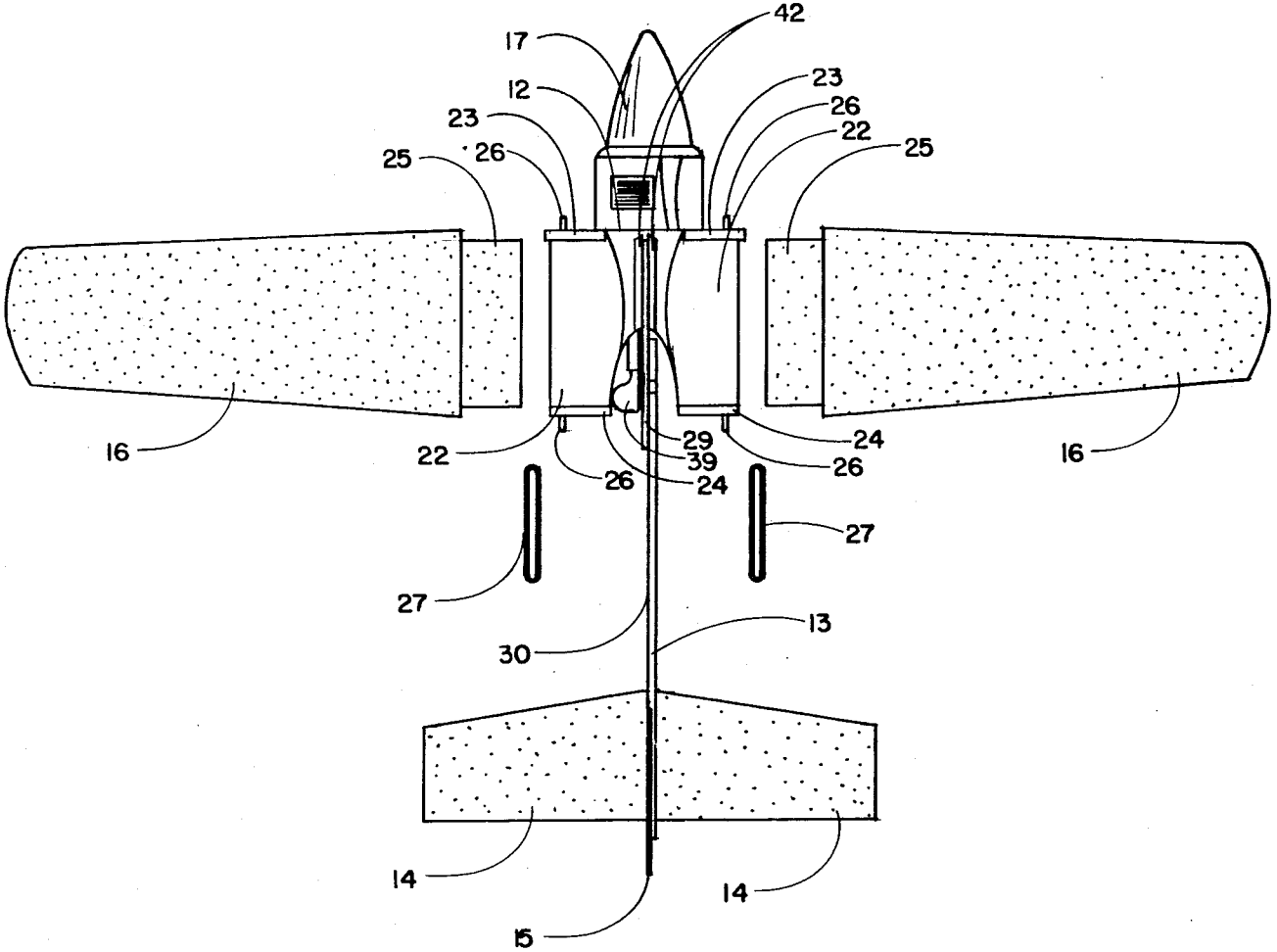
FIG. 6 is an exploded top plan view thereof.

Aligned pins 26 are provided on the forward and trailing edges of each of the outer panels 22 of saddle 12 and are adapted to hold an elastomer securing means such as rubber bands 27 in place as can clearly be seen in FIGS. 4 and 5.

Shoulders 42 of saddle 12 form an elongated slot and have elongated tail boom 13 mounted therebetween. An opening is provided in the forward upper portion of said boom to give the visual impression of a cockpit as indicated at 28. Also, a plurality of perforations can be provided to lighten the weight of the member if so desired. As shown in the drawings, the cockpit portion 29 or tail boom 13 is secured to the wing saddle 12 while the rear portion 30 secured thereto extends rearwardly to the tail.

The rearward end of tail boom 13, of course, terminates in normal elevator and rudder configurations. Since elevator and rudder configurations of this type are well known to those skilled in the art, further detailed discussion of the same is not deemed necessary.

Figure 2:
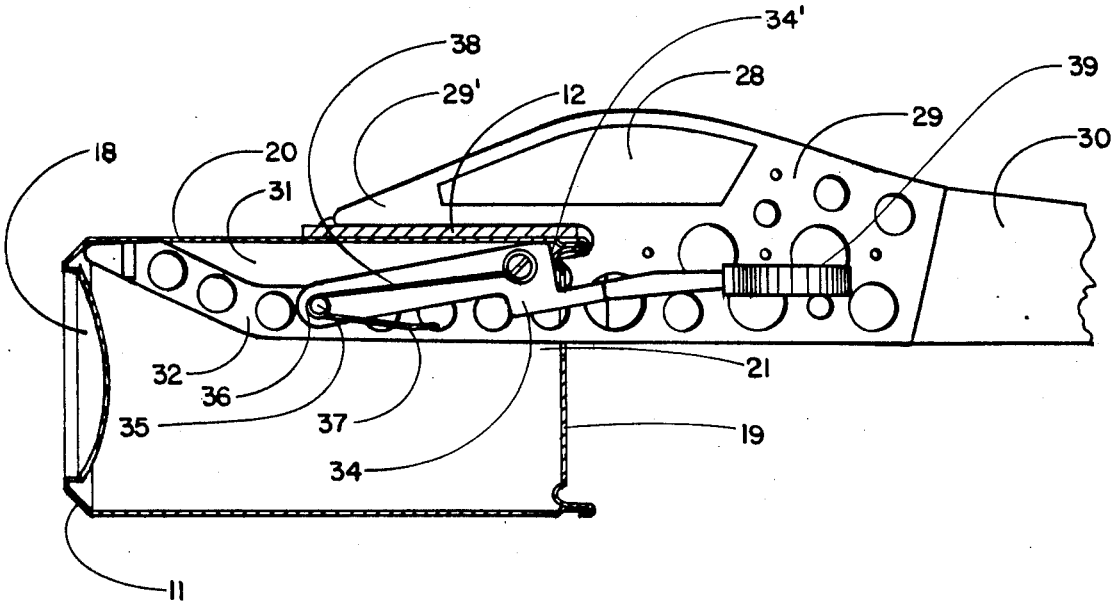
FIG. 2 is a sectional view of the can fuselage thereof.

An elongated, slot-like opening 31 is provided in cockpit portion 29 with a fixed, jaw-like member 32 extending forwardly thereof as shown clearly in FIG. 2. A locking lever 34 is pivotably secured at one end to pin 35 which is fixedly secured to portion 29. A biasing spring 36 is also mounted on pin 35 and has one arm 37 thereof secured to portion 29 and the other arm 38 thereof is secured to locking lever 34 as can clearly be seen in FIG. 2.

The end of locking lever 34 opposite mounting pin 35 includes a lever handle 39.

The mount nose cone 17 on drink can fuselage 11, a suction cup 40 having an outwardly projecting portion 41 is provided. The suction cup is preferably moistened and placed against the can bottom 18 and is held in place by the vacuum created by the cup. Next, the nose cone can be placed in engagement with the projecting portion 41 thus mounting the cone on the can in relative fixed position. Since suction cups of this type are well known to those skilled in the art, further detailed discussion of the same is not deemed necessary.

To assemble the aircraft of the present invention, an empty pop top type drink can is selected. Next, the central portion of wing saddle 12 is placed juxtaposed to the exterior of said can with the pop top opening 21 of can 11 adjacent to saddle 12 and in line with elongated slot formed by shoulders 42 of saddle 12. Therefore, the boom portion 13 of the present invention is manipulated so that the jaw-like member 32 of the cockpit portion 29 enters the pop top opening 21 in the top 19 of can 11. Spring 36 will allow locking lever 34 to pivot so that it can be pushed into the interior of can 11 along with jaw-like member 32.

Once the locking lever 34 has entered the can, biasing spring 36 moves such lever to the position shown in FIG. 2 wherein shoulder 34' of locking lever 34 engages the interior of top 19 thus preventing member 32 from being withdrawn from the can. The end of member 32 will also bear against the interior of the wall 20 providing stability to tail boom 13 which is essential for flight purposes. During the inserting procedure of the cockpit portion 29, the forward portion 29' of cockpit portion 29 will slide in the slot formed by raised shoulders 42 of wing saddle 12 providing further stability to tail boom 13 and will also bear against wing saddle 12, holding it in firm contact with the can which is essential for flight purposes.

Thus, it can be seen that once locking lever 34 engages the interior of top 19, biasing spring 36 will hold such locking lever tightly against the interior of wall 20 not only prevent member 32 from being withdrawn from the can 11, but also maintaining the cockpit portion 29' in the slot-like groove formed by shoulders 42.

Figure 3:
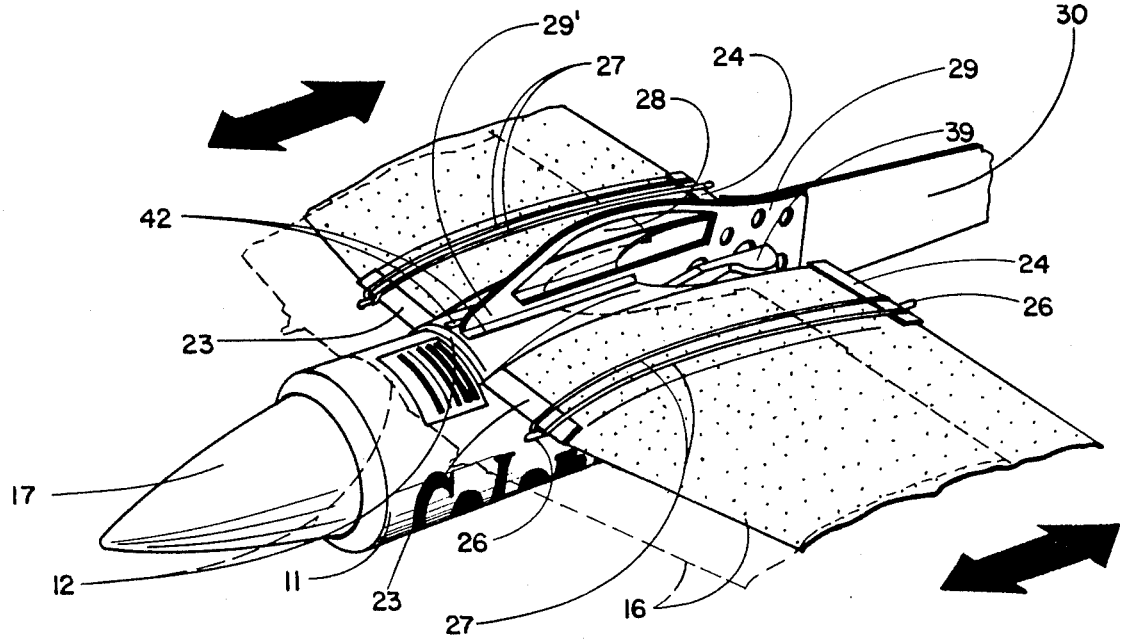
FIG. 3 is a fragmentary view of the can fuselage showing the wing adjustment.

Although the cockpit portion 29 is held in relative fixed position to can 11, saddle 12 can be moved longitudinally, forwardly and rearwardly under said cockpit portion, sliding between shoulders 42, as is clearly illustrated in FIG. 3. This allows not only for compensation to be made for different weights of fuselage cans 11, but also allows the glide angle to be adjusted. For example, a rearward adjustment of the saddle and, of course, the associated wings, will give a steeper glide slope and faster speed which are more suitable for windy conditions while adjusting the same forwardly will give a lesser or shallower glide slope and slower speed which are more suitable for calm wind conditions. Since the effects of adjustments of this type are well known to those skilled in the art, further detailed discussion of the same is not deemed necessary.

Once the cockpit portion/wing saddle/drink can fuselage have been interconnected and mounted as hereinabove described, the wing tabs 25 are placed over the outer panels 22 on opposite sides wing saddle 12. The elastomer or rubber bands 27 are then placed over one of the pins 26 and stretched the chord of the wing and into engagement with the second pin in longitudinal alignment therewith. The pressure of the rubber band 27 will hold the associated wing 16 in place and is strong enough to retain the connection in flight conditions. Should, however, the wing encounter an obstruction such as a tree, pole, or the earth, the rubber band will allow the wing 16 to be knocked loose from the saddle 12 thus providing a break away system which prevents damage to the wing and various parts of the aircraft itself.

After a crash as described above, the wing can simply be reinserted on the saddle 12 under the bands 27 and the aircraft is again ready to fly.

Whenever it is desired to remove the drink can fuselage 11 from the other parts of the present invention, the lever handle 39 is simply pushed downwardly, as shown in FIG. 2, to disengage shoulder 34' of lever 34 from the interior of drink can top 19. Such lever and its associated jaw-like member 32 can then be removed from the can through opening 21 and a new can can be mounted as hereinabove described.

Although the aircraft of the present invention can be readily hand launched, to reach greater heights with the associated much longer flights, downwardly and rearwardly projecting launch hooks 43 are provided on the underside of saddle 12. Loops or similar means in the ends of a "Y" shaped launch line can be placed over launch hooks 43 and as the launch line is rapidly retrieved, whether mechanically or manually, the aircraft 10 will rise in the air until it reaches a near vertical position relative to said launch line, at which time the launch hook 43 will automatically disengage the same. Since launch hooks of this general type and their manner of operation are well known to those skilled in the art, further detailed discussion of the same is not deemed necessary.

From the above it can be seen that the present invention has the advantage of providing a relatively simple, inexpensive, and yet highly efficient model type aircraft which utilizes, for both weight and balance purposes as well as aesthetics and novelty, commonly available pop top type drink cans. No tools or special skills are required to assemble and fly the aircraft of the present invention and the drink can fuselage can be readily changed as desired.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. an improved aircraft comprising: a wing saddle means; wing means; means for releasably securing said saddle means to said wing means; tail means; means for releasably securing said tail means to said saddle means; and means for releasably mounting at least one can-type means to said saddle means whereby an improved aircraft utilizing at least one can as a fuselage is provided.

2. The improved aircraft of claim 1 wherein said means for securing said saddle means to said wing means is at least one elastic member which is stretched to form a releasable connection.

3. The improved aircraft of claim 2 wherein said means for securing said tail means to said saddle means is a boom-like member.

4. The improved aircraft of claim 1 wherein said means for releasably mounting said can to said saddle means is a spring biased lever arm which slides interiorly of said can to engage the same.

5. The improved aircraft of claim 1 wherein said can is of the drink type.

6. The improved aircraft of claim 5 wherein said drink can is of the pop top type.

7. The improved aircraft of claim 1 wherein said saddle is longitudinally adjustable relative to said can whereby the glide slope flight characteristics of said aircraft can be adjusted.

8. The improved aircraft of claim 1 wherein a nosecone is secured to said can.

9. The improved aircraft of claim 8 wherein said nosecone is secured to said can by means of a suction-type device.

10. The improved aircraft of claim 9 wherein said suction-type device is a suction cup.

11. A glider comprising: at least one cylindrical beverage container; airfoil means including wing means and tail means for producing a lifting force when moved through the air; and means for securing said airfoil means to said beverage container which includes a wing saddle which conforms to the contour of said beverage container and wherein said wings are secured to said wing saddle means, whereby when the glider is moved through the air said beverage container is enabled to fly in the manner of heavier than air aircraft.

12. The glider of claim 11 wherein said securing means further includes a slot-like opening formed at one end of said tail means and wherein said saddle means and said beverage container slide edgewise into said slot-like opening in said tail means.

13. The glider of claim 12 wherein said securing means further includes a spring-biased lever arm insertable into said beverage container for engaging inner surface of said can to secure said beverage container and said wing saddle in said slotlike opening.

* * * * *